US007401614B2

(12) United States Patent
Ruzumna

(10) Patent No.: US 7,401,614 B2
(45) Date of Patent: Jul. 22, 2008

(54) PAINT BRUSH SAVER

(76) Inventor: Edward Ruzumna, 3974 Winterset Ct., West Bloomfield, MI (US) 48323

( * ) Notice: Subject to any disclaimer, the term of this patent is extended or adjusted under 35 U.S.C. 154(b) by 628 days.

(21) Appl. No.: 10/993,504

(22) Filed: Nov. 22, 2004

(65) Prior Publication Data

US 2006/0108238 A1 May 25, 2006

(51) Int. Cl.
*B08B 3/08* (2006.01)
*B65D 39/14* (2006.01)

(52) U.S. Cl. ..... 134/135; 206/15.3; 206/361; 206/702; 206/736

(58) Field of Classification Search ..... 134/135, 134/900; 206/15.3, 15.2, 361; 202/361, 202/736, 702; 220/736, 702
See application file for complete search history.

(56) References Cited

U.S. PATENT DOCUMENTS 4,155,230 A * 5/1979 Lacher, Jr. ..... 68/213
4,513,865 A * 4/1985 Melzi et al. ..... 206/508
4,759,441 A * 7/1988 Leurck ..... 206/373
5,301,799 A * 4/1994 Gurba, Jr. ..... 206/1.7
5,662,617 A * 9/1997 Odell et al. ..... 604/192
5,829,603 A * 11/1998 Martineau ..... 211/66

* cited by examiner

*Primary Examiner*—Michael Barr
*Assistant Examiner*—Saeed T Chaudhry
(74) *Attorney, Agent, or Firm*—Alex Rhodes

(57) ABSTRACT

A brush saver for cleaning and preserving the useful life of a paint brush comprising a transparent body for enclosing and suspending a paint brush and a solvent in a sealed vertical orientation, and a removable top cap for engaging the handle of the paint brush and preventing the bristles of the paint brush from being distorted. In a preferred embodiment, a handle of the paint brush extends upwardly out of the brush saver and the bristles of the paint brush are enclosed with the solvent in the brush saver. The brush saver may also have a permanent magnet on the side of the body for attaching the saver on a paint can, an absorbent open cell pad in the interior of the body and a removable cap on a side of the body for adding and removing solvent from the enclosure.

13 Claims, 4 Drawing Sheets

PAINT BRUSH SAVER

FIELD OF THE INVENTION

This invention relates to paint brush cleaners and holders and more particularly to a paint brush holder for cleaning and conserving the life of a paint brush.

BACKGROUND OF THE INVENTION

Experienced painters recognize the value of a clean, well maintained paint brush. A clean, well maintained paint brush reduces time and produces a quality job. Painting with a clean, well maintained paint brush produces finishes which are smooth, even, free of runs and bristles. When painting it is often necessary to stop and prevent the paint from hardening on a brush. After painting is finished, a brush must be cleaned and stored to preserve its life. Improper cleaning and storage will diminish a brush's performance and shorten its life. It can increase expenses, particularly when an expensive paint brush is not properly cleaned and stored.

Several methods are used for cleaning and preventing paint from hardening on a paint brush. One method is to wash the brush in an open container with a petroleum distillate, such as a chlorinated solvent, turpentine or paint thinner. Some chlorinated solvents emit vapors which are classified as carcinogenic. Vapors of some solvents, such as naphtha and toluene can aggravate physical conditions such as asthma or injure respiratory systems. Recent laws require commercial cleaners to use closed systems which prevent discharges of vapor into the environment.

Another method is to soak and wash a brush in warm soapy water. This method is time consuming and except for water based paints is inferior to washing a brush in a petroleum distillate. Another method is to store a brush upright in an open container in paint or a solvent. As long as the bristles of the brush are immersed in the paint or solvent, they will remain flexible and capable of holding paint. Unfortunately, this solution does not prevent an undesirable discharge of vapors or prevent the bristles from becoming deformed. If the brush is supported on the bristles for a long period of time, the bristles may become so deformed as to become useless.

The present invention solves all of the above problems. The invention of a brush saver comprises a transparent vertical body of sufficient length for enclosing and preventing the bristles of a paint brush from contacting the walls of the body; a removable cap for supporting the brush and sealing the body; and a lower base for supporting the brush saver in a vertical position on a surface. An optional permanent magnet is provided on the side of the body for attaching the brush saver to a side of a paint can or other metallic surface. In a preferred embodiment, a removable cap is provided on the side of the body for adding and removing solvent and paint. In a second embodiment, an absorbent open cell pad is provided inside of the saver.

In employing the teaching of the present invention, alternate constructions can be adopted to achieve the desired results and capabilities. In this disclosure, although several embodiments are discussed, the disclosed embodiments are intended as examples only and should not be considered as limiting the scope of the invention.

Further features and benefits will be apparent by reference to the drawings and ensuing detailed description of a preferred embodiment which discloses the best mode contemplated in carrying out the invention. The exclusive rights which are claimed are set forth in the numbered claims following the detailed description of the preferred embodiment.

BRIEF DESCRIPTION OF THE DRAWINGS

The invention will be better understood and further objects, characterizing features, details and advantages thereof will appear more clearly with reference to the diagrammatic drawings illustrating preferred features of the invention by way of non-limiting examples only.

DETAILED DESCRIPTION OF A PREFERRED EMBODIMENT

Figure 3:
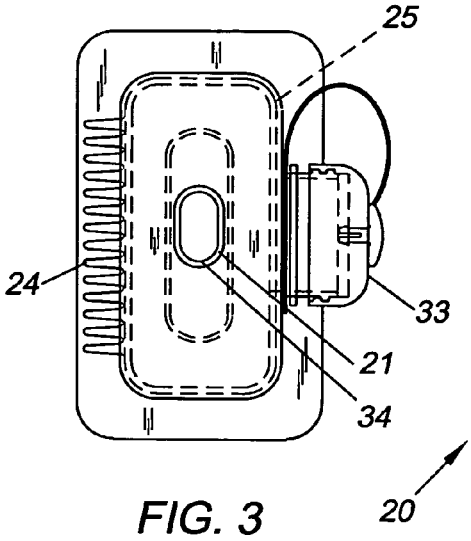
FIG. 3 is a plan view of the paint brush saver.
Figure 4:
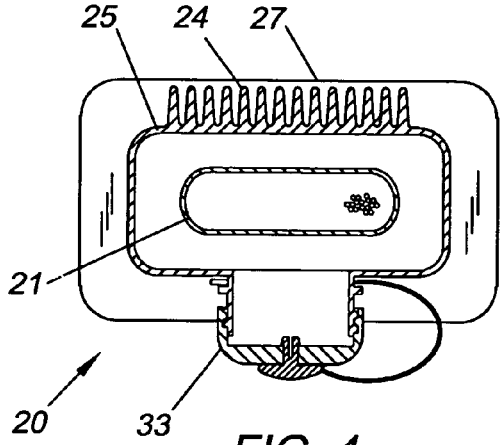
FIG. 4 is a cross-sectional view taken on the line 44 in FIG. 1.
Figure 2:
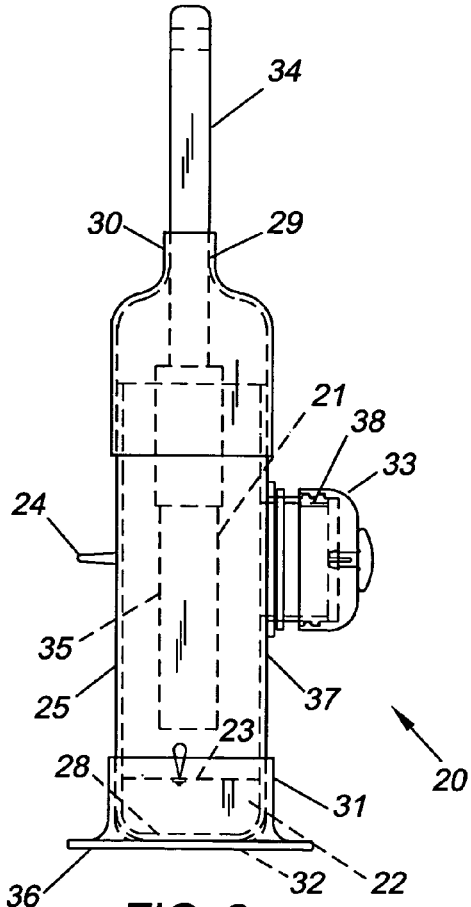
FIG. 2 is a right side view of the paint brush saver.

Referring now to the drawings wherein like numerals designate like and corresponding parts throughout the several views, in FIGS. 1 through 4, a brush saver 20 with a brush 21, in phantom, is shown according to the present invention. One feature of the brush saver 20 is that it is sealed to prevent noxious vapors from discharging into the environment. Another feature is that it can be used with various size brushes. Another feature is that solvents 23 can be added or removed after brushes 21 are installed and the saver 20 is sealed. Another feature is a reservoir space 22 at the bottom of the saver 20 for capturing paint and solvent 23. Another feature is that brushes 21 are spaced apart from the interior of the saver 20. Another feature is that brushes 21 are suspended in a vertical position, above the lower reservoir space 22. Another feature is that a comb 24 is provided on an exterior surface of the saver 20.

One benefit of the invention is that it reduces the use of solvent 23 over current practices. Another benefit is that it reduces the time for cleaning a brush 21 over current practices. A still further feature is that it preserves the quality of a brush 21.

Figure 1:
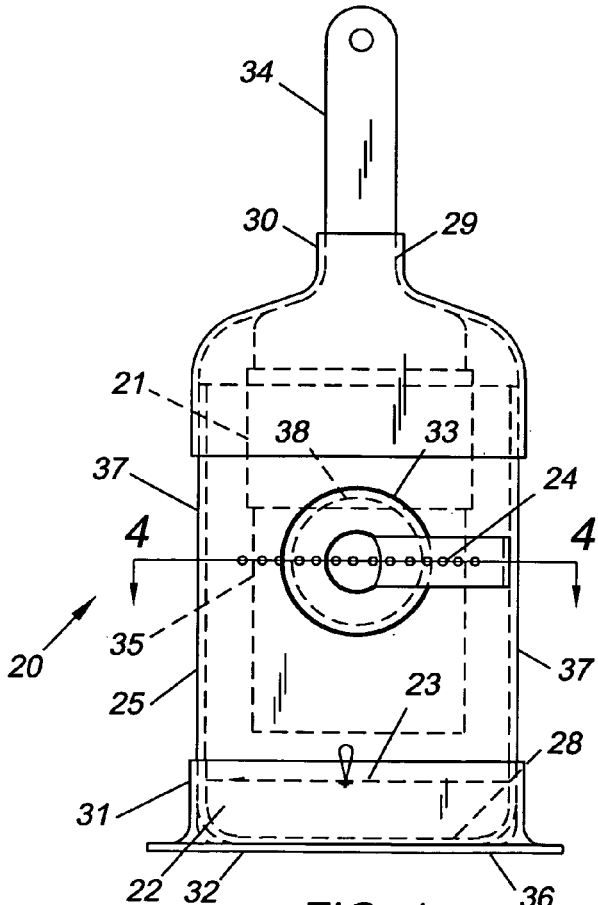
FIG. 1 is a front view of a paint brush saver according to the present invention.
Figure 8:
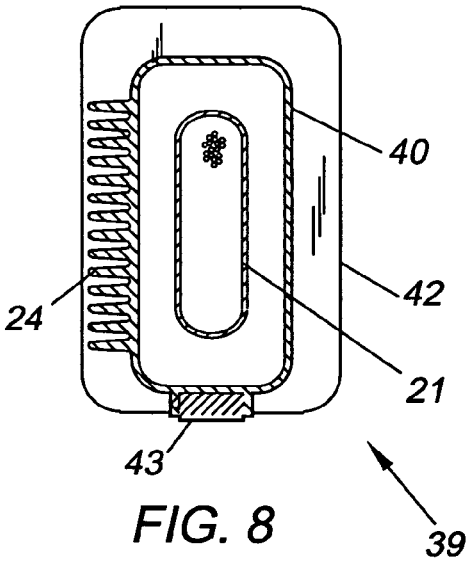
FIG. 8 is a cross-sectional view taken on the line 8-8 in FIG. 5.
Figure 6:
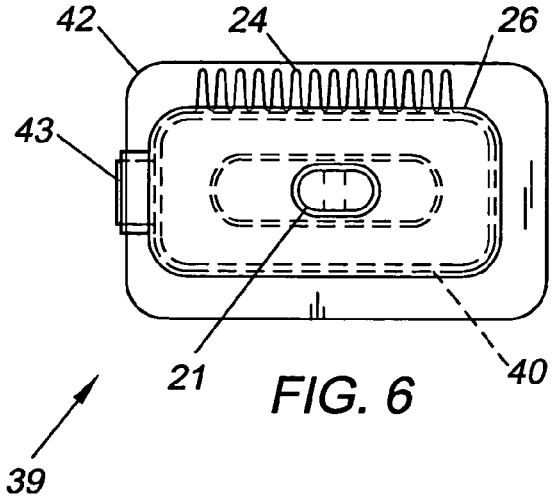
FIG. 6 is a plan view of the second embodiment.
Figure 7:
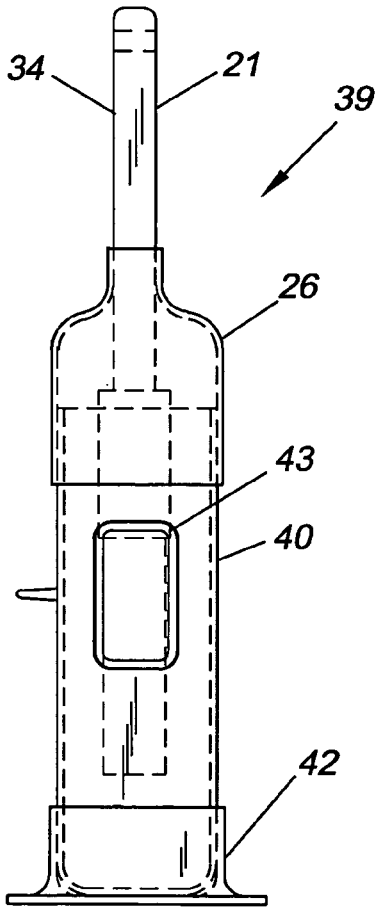
FIG. 7 is a right side view of the second embodiment.
Figure 5:
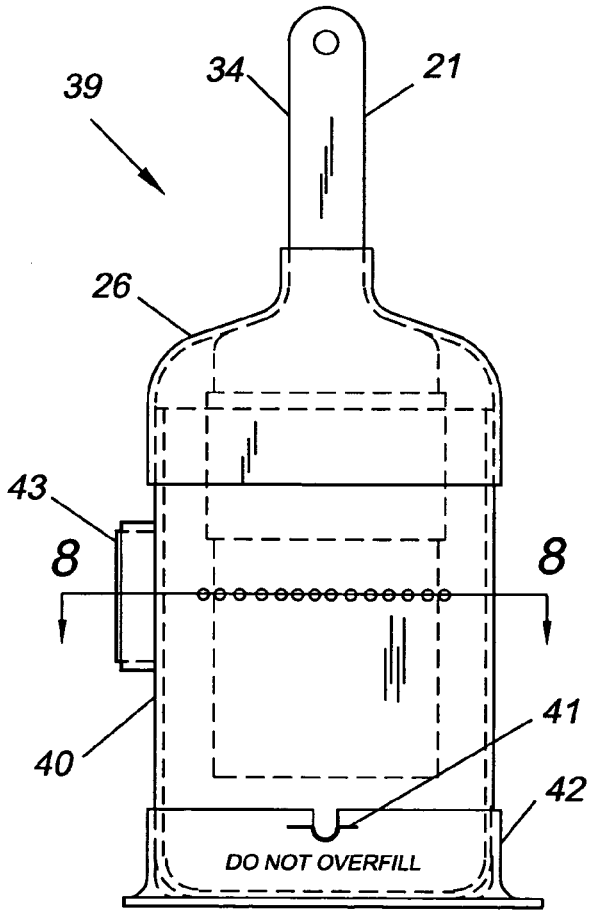
FIG. 5 is a front view of a second embodiment of the paint brush saver.
Figure 11:
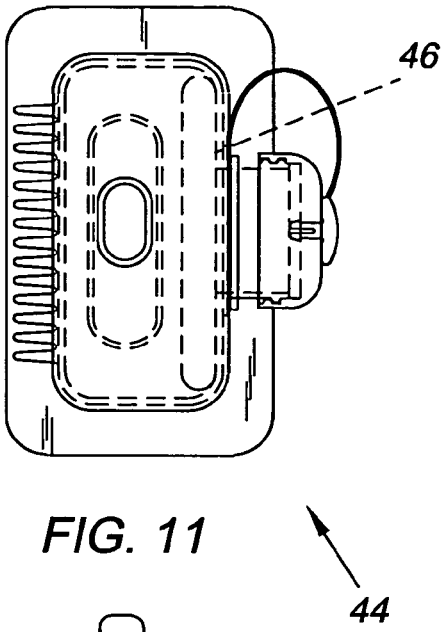
FIG. 11 is a plan view of the third embodiment.
Figure 12:
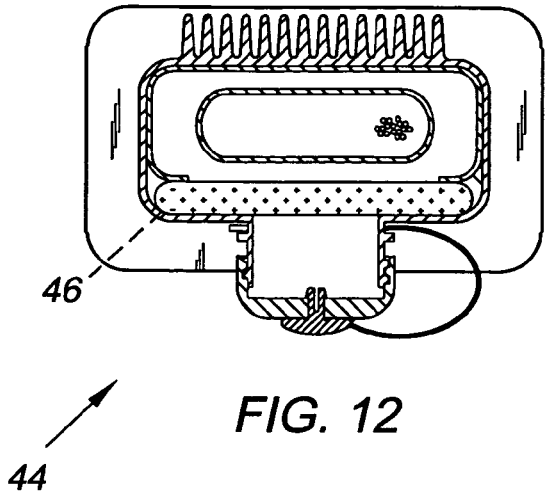
FIG. 12 is a cross-sectional view taken on the line 12-12 in FIG. 9.
Figure 10:
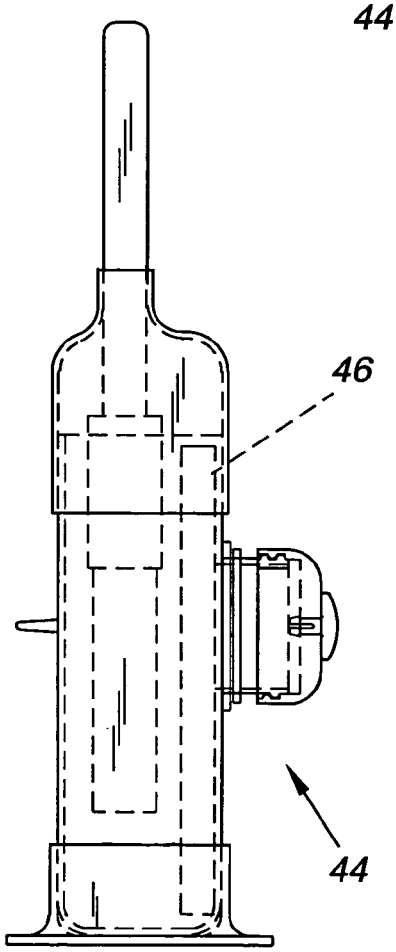
FIG. 10 is a right side view of the third embodiment.
Figure 9:
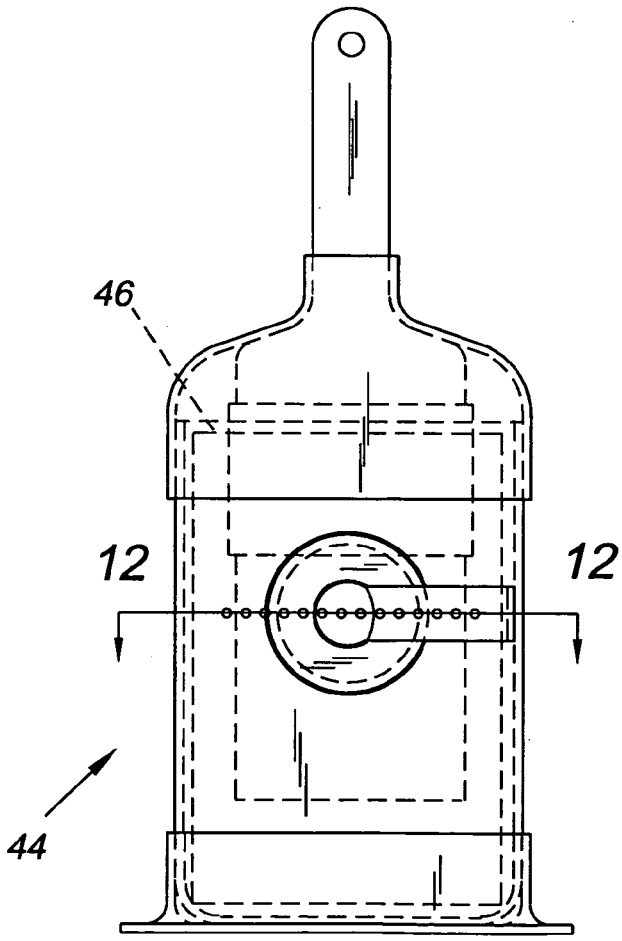
FIG. 9 is a front view of a third embodiment of the paint brush saver.
Figure 15:
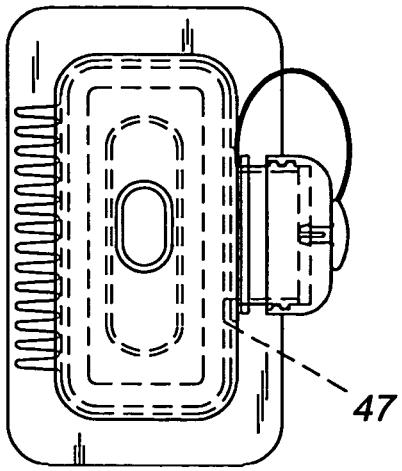
FIG. 15 is a plan view of the fourth embodiment.
Figure 16:
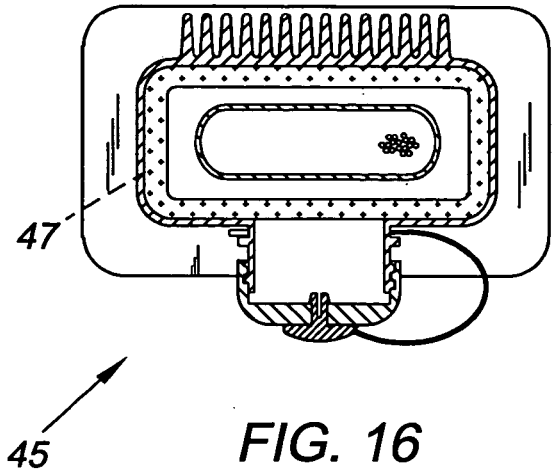
FIG. 16 is a cross-sectional view taken on the line 16-16 in FIG. 13.
Figure 14:
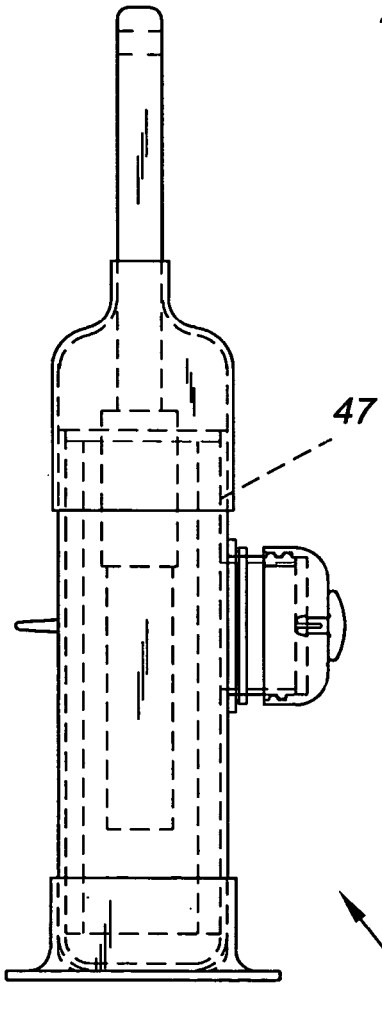
FIG. 14 is a right side view of the fourth embodiment.
Figure 13:
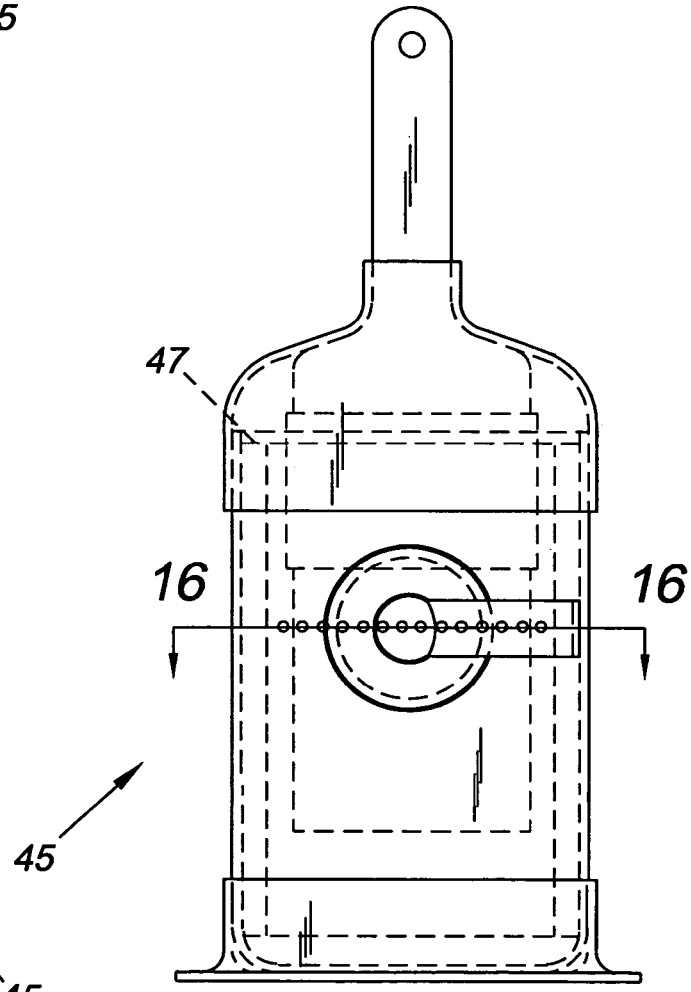
FIG. 13 is a front view of a fourth embodiment of the paint brush saver.

The brush saver 20 is comprised of a thin wall elongated vertical body 25, a removable top cap 26 which slidably engages the body 25 and a lower base 27. The body 25 is preferably transparent for viewing the condition of the brush 21 which is suspended inside of the saver 20. As shown in FIG. 1, the height of the body 25 is sufficient to space the brush 21 above any paint and solvent which may have collected in the reservoir space 22. With the top cap 26 removed, the body 25 is open and ready to receive the paint brush 21. The bottom of the body 25 may be closed as shown in FIG. 1 with a lower wall 28 or open and sealed with the base 27. The width and depth of the body 25 are sufficient to clear the brush 21 in the interior of the saver 20.

The top cap 26 which slidably engages the body 25 is preferably made of a flexible material such as polyvinylchloride. At the center of the top cap 25 there is an aperture 29 which is surrounded by an upward extending wall 30. The aperture 29 expands circumferentially to grip the brush handle 34 in sealing relationship to the handle 34. The top cap 26 is capable of gripping and sealing various size handles 34. The base 27 tightly engages the body 25 and has a flat lower surface 36 to support the saver 20. The base 27 is comprised of a vertical wall 31 and an adjoining lower horizontal wall 32. The lower wall 32 preferably extends outwardly from the side 37 of the body 25.

Extending outwardly from the side 37 of the body 25 is a second removable cap 33. Opposite of the cap 33, on the side 37 of the body 25 is the comb 24 which is used, if required, for separating the bristles 35 of the brush 21.

The preferred manner of using the brush saver 20 is as follows. The handle 34 of the brush 21 is wiped clean of paint and inserted into the aperture 29 of the top cap 26 as shown in FIG. 1. The top cap 26 is slidably engaged with the top of the body 25 with the bristles 35 of the brush 21 extending downwardly into the body 25. After the top cap 26 has been installed on the body 25, a small quantity of a petroleum distillate 23 or other liquid solvent 23 is added to the saver through the aperture 38 on the side of the body 25.

The side cap 33 is then threadably engaged with the body to close off the aperture 38 as shown in FIG. 1 and seal the brush saver 20. The brush saver 20 is vigorously shaken to clean the brush 21 and to force the paint and solvent 23 on the brush 21 to flow into the reservoir space 22 at the bottom of the saver 20. The saver 20 is then placed on a surface to further deposit paint and solvent 23 into the reservoir space 22. When sufficient paint and solvent 23 as viewed through the transparent body 25 have been removed from the brush 21, the side cap 33 is removed and the reservoir space 22 is emptied of paint and solvent 23.

If sufficient paint and solvent 23 have not been removed, additional solvent is added and the saver 20 vigorously shaken until additional paint and solvent 23 have been removed. This process is repeated until the brush 21 has been adequately cleaned. After the brush 21 has been cleaned, the saver 20 is emptied of spent paint and solvent 23 and a small amount of clean solvent 23 is added to the saver 20 for storing the brush 21. The saver 20 is then stored rested in an upright position to allow solvent vapors to remove any residual paint 23 from the brush 21. When the brush 21 is removed from the saver 20, the bristles 35 of the brush 21 are passed through the comb 24 to separate any bristles 35 which may have adhered to each other.

In FIGS. 5 through 8 an alternate embodiment 39 is shown without a second cap on the side of a body 40. With this embodiment 39, a solvent 23 must be added and removed through the top of the body 40 before the top cap 26 is installed. A mark 41 is provided on a base 42 as a guide for the quantity of solvent 23 in the saver 39. Except for the manner of adding and removing paint and solvent 23 from the saver 39, the method of using the alternate embodiment 39 is similar to the first embodiment 20. An optional feature in this embodiment 39 is a permanent magnet 43 on the side of the body 40 for attaching the saver 39 to the side of a metal paint can (not shown) or other metallic object.

In FIGS. 9 through 17 are shown two embodiments 44, 45 with absorbent open cell pads 46, 47 in the interior of the savers 44, 45 for saturating the interiors with solvent vapors. The absorbent pads 46, 47 maintain the bristles 35 of the brush 21 soft and resilient by slowly replenishing solvent 23 which has been expended in removing paint from the brush 21. In FIGS. 9 through 13, the cellular pad 46 is a flat rectangular pad whereas in FIGS. 14 through 18 the cellular pad 47 is a hollow rectangular pad.

From the foregoing it is apparent that my invention provides a means for cleaning and preserving a paint brush with many important advantages and benefits over the prior art. One important benefit is that it prevents a discharge of harmful solvent vapors into the environment. Another important benefit is that it reduces the use of solvents. Another important benefit is that it reduces the time for cleaning a paint brush. A third important benefit is that it preserves the life of a paint brush.

Although only several non-limiting embodiments of my invention have been disclosed for the purpose of described my invention, it will be appreciated that after having the benefit of my disclosure other embodiments can be derived by changes which are obvious to persons skilled in the art, such as inversions of elements as well as changes in materials, shape, substitution, elimination and rearrangement of parts, without departing from the spirit and concepts thereof.

I claim:

1. In combination with a small amount of a volatile solvent, a device for cleaning and preserving a paint brush comprising a transparent hollow body for enclosing the bristles of a paint brush and said volatile solvent, said body having an open top, a vertical wall, a bottom wall, a reservoir space at the bottom of said body for capturing paint from said bristles and holding said small amount of said volatile solvent and a space for suspending said bristles in a solvent vapor environment; a thin flexible cap, said cap having an upper portion for slidably engaging in sealing relationship a handle of said paint brush and a lower portion for slidably engaging in sealing relationship an upper portion of said body; and a second removable cap for sealing an aperture in said vertical wall of said body.

2. The combination recited in claim 1 wherein said bottom wall is an integral portion of said body.

3. The combination recited in claim 1 wherein said bottom wall extends outwardly from said vertical wall.

4. The device recited in claim 3 further comprising a permanent magnet on said vertical wall of said body for attaching said device to a paint can or other metallic article.

5. The combination recited in claim 1 further comprising indicia on said vertical wall for indicating the amount of said volatile solvent in said body.

6. The device recited in claim 1 wherein said second removable cap threadably engages said vertical wall of said body.

7. The device recited in claim 1 further comprising an absorbent open cell pad in an interior of said body for storing a solvent in said pad and releasing vapors of said solvent into said interior of said body.

8. The device recited in claim 7 wherein said absorbent open cell pad is a planar rectangular shaped pad.

9. The device recited in claim 7 wherein said absorbent open cell pad is a rectangular tubular pad.

10. The device recited in claim 1 wherein said vertical wall includes an indicia for indicating a maximum level of solvent in said device.

11. The device recited in claim 1 further comprising a comb extending outwardly from said vertical wall of said body.

12. In combination with a small amount of a volatile solvent, a device for cleaning and preserving a paint brush comprising a transparent hollow body for enclosing the bristles of a paint brush and said small amount of said volatile solvent, said body further having an open top, a front wall, spaced apart side walls and a bottom wall, said front wall having an aperture for adding and removing said solvent from said device; a reservoir space at the bottom of said body for capturing paint from said bristles and holding said small amount of said volatile solvent and a space for suspending said bristles in a solvent vapor environment; and a thin flexible cap, said cap having an upper portion for slidably engaging in sealing relationship an outward extending handle of said paint brush and a lower portion for slidably engaging in sealing relationship an upper portion of said body.

13. In combination with a small amount of a volatile solvent, a device for cleaning and preserving a paint brush comprising a transparent hollow body for enclosing the bristles of a paint brush and said small amount of said volatile solvent, said body further having an open top, a front wall, spaced apart side walls and a bottom wall, said front wall having an aperture for adding and removing said solvent from said device; a reservoir space at the bottom of said body for capturing paint from said bristles and holding said small amount of said volatile solvent and a space for suspending said bristles in a solvent vapor environment; a thin flexible cap, said cap having an upper portion for slidably engaging in sealing relationship a handle of said paint brush and a lower portion for slidably engaging in sealing relationship an upper portion of said body; indicia on said vertical wall for indicating the amount of said volatile solvent in said body; and a comb on said vertical wall for separating said bristles of said brush.

* * * * *